US011865608B2

(12) United States Patent
Fujito et al.

(10) Patent No.: US 11,865,608 B2
(45) Date of Patent: Jan. 9, 2024

(54) METHOD OF MANUFACTURING WIRE ROD AND APPARATUS OF MANUFACTURING WIRE ROD

(71) Applicant: Proterial, Ltd., Tokyo (JP)

(72) Inventors: Keisuke Fujito, Tokyo (JP); Takayuki Tsuji, Tokyo (JP); Shohei Hata, Tokyo (JP)

(73) Assignee: Proterial, Ltd., Tokyo (JP)

( * ) Notice: Subject to any disclaimer, the term of this patent is extended or adjusted under 35 U.S.C. 154(b) by 0 days.

(21) Appl. No.: 17/544,006

(22) Filed: Dec. 7, 2021

(65) Prior Publication Data

US 2022/0203433 A1 Jun. 30, 2022

(30) Foreign Application Priority Data

Dec. 28, 2020 (JP) ..... 2020-218285

(51) Int. Cl.
*B22D 11/108* (2006.01)

(52) U.S. Cl.
CPC ..... *B22D 11/108* (2013.01)

(58) Field of Classification Search
CPC ..... B22D 11/10; B22D 11/108
USPC ..... 164/459, 461, 462, 423, 427, 433, 434, 164/482
See application file for complete search history.

(56) References Cited

U.S. PATENT DOCUMENTS 3,726,331 A * 4/1973 Bunting, Jr. ..... B22D 11/112 164/475
3,831,660 A * 8/1974 Hill ..... B22D 11/20 164/418
4,066,475 A * 1/1978 Chia ..... C22F 1/08 427/435
4,143,211 A * 3/1979 Obinata et al. ..... B22D 11/111 428/650
4,652,299 A * 3/1987 Bienvenu et al. ..... C21C 7/06 75/304
5,291,939 A * 3/1994 Hensley et al. .... B22D 11/0611 164/483

FOREIGN PATENT DOCUMENTS

JP 2013048225 A 3/2013

OTHER PUBLICATIONS

Machine translation of JP 2013-048225 A (Year: 2013).*

* cited by examiner

*Primary Examiner* — Kevin P Kerns
(74) *Attorney, Agent, or Firm* — McCormick, Paulding & Huber PLLC

(57) ABSTRACT

A manufacturing efficiency of the wire rod made of the cast alloy including the additive element having the high activity to the oxygen is improved. An apparatus of manufacturing a wire rod includes: a tundish storing a molten metal; a mold for use in continuously casting the molten metal fed from the tundish; and an additive-element feeding unit continuously feeding an additive element (wire) to a feeding port of the mold.

7 Claims, 6 Drawing Sheets

METHOD OF MANUFACTURING WIRE ROD AND APPARATUS OF MANUFACTURING WIRE ROD

CROSS-REFERENCE TO RELATED APPLICATION

The present application claims priority from Japanese Patent Application No. 2020-218285 filed on Dec. 28, 2020, the content of which is hereby incorporated by reference into this application.

TECHNICAL FIELD OF THE INVENTION

The present invention relates to a method of manufacturing a wire rod, and an apparatus of manufacturing a wire rod.

BACKGROUND OF THE INVENTION

Methods of continuously casting a cast alloy that is a material of a wire rod include a method of continuously casting a molten metal by continuously pouring a metal to be a master material of the cast alloy and a molten metal mixed with an additive element into a mold (see, for example, Patent Document 1).

RELATED-ART DOCUMENT

Patent Document

Patent Document 1: Japanese Patent Application Laid-Open Publication No. 2013-048225

SUMMARY OF THE INVENTION

In the case of the mixture of the molten metal with the additive element in the method of manufacturing the wire rod by using a continuous cast rolling method, a method of previously mixing the molten metal with the additive element before the pouring of the molten metal into the mold is preferable in consideration of a layout of a feeding apparatus that feeds the additive element to the molten metal or others. However, the following problems have been found from the studies of the inventors of the present application. That is, when the molten metal previously mixed with the additive element is poured into the mold, oxygen or others in air existing between the mold and a tundish storing the molten metal is included in the molten metal, and the molten metal including the oxygen or others is poured into the mold in some cases. Particularly when the additive element includes an element having high activity to the oxygen, a part of the additive element and the oxygen adversely react with each other to reduce an yield of addition. In other words, in a case of manufacturing the wire rod from the molten metal including the additive element having the high activity to the oxygen, a manufacturing efficiency of the wire rod is reduced in some cases.

Accordingly, a purpose of the present invention is to provide a technique of improving the manufacturing efficiency of the wire rod made of the cast alloy including the additive element having the high activity to the oxygen.

A method of manufacturing a wire rod according to an embodiment is a method [1] of manufacturing a wire rod by continuous cast rolling, and the method includes a step (a) of providing a molten metal made of a master material, a step (b) of feeding the molten metal into a mold, a step (c) of continuously feeding an additive element to the molten metal in the mold to mix the additive element with the molten metal in the mold, and a step (d) of continuously casting the molten metal mixed with the additive element in the mold to form a cast material.

[2] In the method [1], the additive element has a higher activity to oxygen than the master material.

[3] In the method [1], the additive element is one, two or more types of elements of titanium (Ti), magnesium (Mg), zirconium (Zr), calcium (Ca), aluminium (Al), phosphorus (P), indium (In) and tin (Sn).

[4] In the method [1], the additive element is made of a linear member, and is continuously fed to the molten metal in the mold from an additive-element feeding nozzle arranged between the mold and a tundish storing the molten metal not yet fed to the mold.

[5] In the method [1], a first additive element is continuously fed to the molten metal in the mold in the step (c), and the molten metal fed to the mold in the step (d) includes the master material and a second additive element having lower activity to oxygen than the first additive element.

[6] An apparatus of manufacturing a wire rod according to another embodiment is an apparatus of manufacturing a wire rod by continuous cast rolling, and includes: a tundish storing a molten metal; a mold for use in continuously casting the molten metal fed from the tundish; and an additive-element feeding unit continuously feeding an additive element to a feeding port of the mold.

[7] In the apparatus [6], the additive-element feeding unit includes an additive-element feeding nozzle from which the additive element made of a linear member is continuously fed to the feeding port of the mold, and the additive-element feeding nozzle is arranged between the mold and the tundish.

A typical embodiment of the present invention can improve a manufacturing efficiency of a wire rod made of a cast alloy including an additive element including an additive element having high activity to oxygen.

BRIEF DESCRIPTIONS OF THE DRAWINGS

DESCRIPTIONS OF THE PREFERRED EMBODIMENTS

Hereinafter, an embodiment of the present invention will be explained with reference to the drawings.

Configuration Example of Apparatus of Manufacturing Wire Rod

Figure 1:
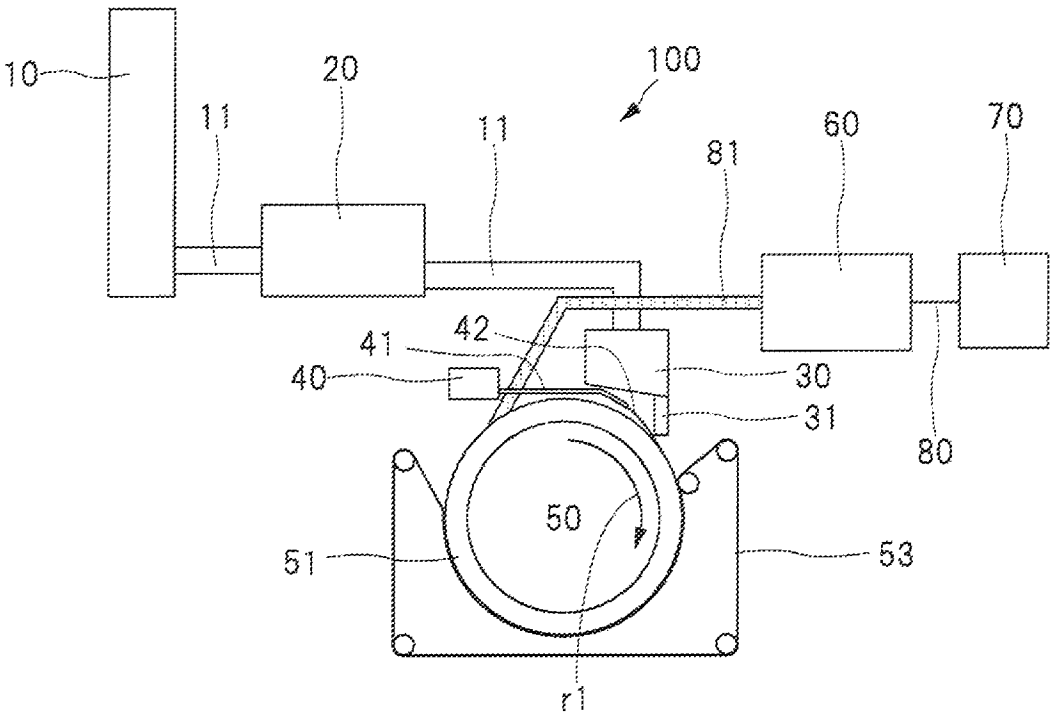
FIG. 1 is an explanatory diagram showing a configuration example of a continuous manufacturing apparatus (continuous cast rolling apparatus) of a wire rod according to an embodiment.
Figure 2:
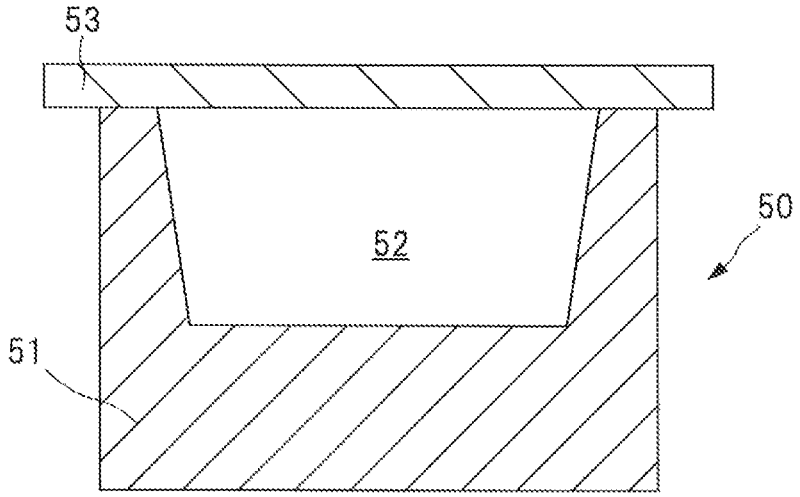
FIG. 2 is an enlarged cross-sectional diagram showing one example of a cross-sectional shape of a groove that is formed in a peripheral portion of a casting wheel shown in FIG. 1.

FIG. 1 is an explanatory diagram showing a configuration example of an apparatus of manufacturing a wire rod according to the present embodiment. FIG. 2 is an enlarged cross-sectional diagram showing one example of a cross-sectional shape of a groove that is formed in a peripheral portion of a casting wheel shown in FIG. 1. A wire rod 80 that is manufactured in the present embodiment is made of a cast alloy including copper as a master material and including an additive element contained in the master material. The wire rod 80 is a wire rod that is further elongated in accordance with intended use to be used for, for example, a conductor wire or others. A method of manufacturing the wire rod 80 that is the copper wire rod made of the cast alloy including the copper as the master material will be exemplified to explain the method of manufacturing the wire rod and the apparatus of manufacturing the same.

As shown in FIG. 1, an apparatus 100 of manufacturing a wire rod of the present embodiment includes a melting furnace 10, a holding furnace 20, a tundish 30, an additive-element feeding unit 40, a mold 50, a rolling unit 60 and a take-up reeling unit 70. By a transfer launder (trough) 11, the melting furnace 10 and the holding furnace 20 are connected to each other, and the holding furnace 20 and the tundish 30 are connected to each other. A nozzle 31 is connected to the tundish 30, a flow rate of the molten metal stored in the tundish 30 and fed to the nozzle 31 is adjusted by a flow-rate adjusting pin not illustrated, and the molten metal is fed into the mold 50 through the nozzle 31.

A method of manufacturing the wire rod of the present embodiment includes a step (master-material melting step) of providing the molten metal by melting copper (such as tough pitch copper, oxygen-free copper, high-purity copper having copper purity of 99.999% to 99.99999%) that is the master material of the cast alloy making up the wire rod 80. This master-material melting step is performed in the melting furnace 10 shown in FIG. 1. The molten metal made of the copper that has been melted in the melting furnace 10 is transferred to the holding furnace 20 through the transfer launder 11. The holding furnace 20 stocks the molten metal while keeping the molten metal melted. The molten metal stocked in the holding furnace 20 is sequentially transferred to the tundish 30 through the transfer launder 11.

In the tundish 30, foreign substances (inclusions) filled in the molten metal are removed (foreign-substance removing step). As a method of removing the foreign substances, for example, a method of skimming and removing the foreign substances floating on a liquid surface of the molten metal is exemplified. Note that FIG. 1 shows an example of the connection between the holding furnace 20 and the tundish 30 through the transfer launder 11. However, as a modification example, a vessel that is called a ladle although not illustrated may intervene between the holding furnace 20 and the tundish 30 in some cases. In this case, the foreign substances may be also removed by the pouring ladle.

The method of manufacturing the wire rod according to the present embodiment also includes a step (molten-metal feeding step) of feeding the molten metal stored in the tundish 30 to the mold 50. In the molten-metal feeding step, for example, the molten copper (molten metal) stored in the tundish 30 is fed to the mold 50 through the nozzle 31. The mold 50 includes a casting wheel 51 having a circular shape in a side view and rotating around a center of the circle as a rotational axis. FIG. 1 schematically shows a rotational direction "r1" of the casting wheel 51.

As shown in FIG. 2, a groove 52 extending in a circumferential direction of the casting wheel 51 is formed in a peripheral portion of the casting wheel 51. And, a casting belt 53 is arranged in the peripheral portion of the casting wheel 51 to face the groove 52 of the casting wheel 51, and the groove 52 and the casting belt 53 function as a mold for casting the molten metal. The molten metal is fed into the mold 50 (in other words, into the groove 52) shown in FIG. 2. The metal fed into the groove 52 is cooled through the casting wheel 51, and is provided as a cast material (ingot) 81 having a shape of the mold 50, in other words, a shape of the groove 52.

Although described in detail later, the method of manufacturing the wire rod according to the present embodiment includes a step (additive-element feeding step) of continuously feeding the additive element to the molten metal in the mold 50. The additive element added to the copper that is the master material of the wire rod 80 is continuously fed from the additive-element feeding unit 40 to a feeding port (also referred to as a feeding port of the mold 50 below) to which the molten metal is fed from the tundish 30. In other words, the groove 52 of the mold 50 is a feeding port to which the molten metal is fed from the tundish 30, and the additive element is continuously fed from the feeding port to the molten metal in the mold 50. A wire 42 shown in FIG. 1 is a wire (linear member) formed by linearly shaping the additive element. By the addition of the additive element to the feeding port of the mold 50 as shown in FIG. 1, the additive element is stirred by convection of the molten metal in the mold 50, and the molten metal and the additive element are mixed. Then, by the continuous casting of the molten metal mixed with the additive element, the cast material 81 made of an alloy of the additive element and the metal (such as copper) configuring the master material is formed.

The method of manufacturing the wire rod according to the present embodiment also includes a step (rolling step) of forming a rolling material by rolling/milling the resultant cast material 81. In the rolling step, the cast material 81 is gradually rolled/milled by, for example, a plurality of rollers (not illustrated) included in a rolling unit 60 shown in FIG. 1 to form the rolling material to be a wire material such as the wire rod 80. A surface cleaning process is performed to the resultant rolling material to provide the wire rod 80.

The wire rod 80 that is a resultant through the rolling step is reeled up on a reel (not illustrated) by the take-up reeling unit 70, and is subjected to a necessary test, and then, is transferred for a step of manufacturing a conductor wire. Alternatively, the wire rod 80 that has been reeled up on the reel by the take-up reeling unit 70 is subjected to a necessary test, and then, is shipped as an intermediate product.

In the method of manufacturing the wire rod according to the present embodiment, note that a molten metal not subjected yet to the mixture with the additive element fed into the mold may be handled as a "first molten metal", and a molten metal in the mold subjected to the mixture with the additive element may be handled as a "second molten metal". For example, the method of manufacturing the wire rod according to the present embodiment is a method of manufacturing the wire rod by the continuous cast rolling, and includes: a step (a) of providing the first molten metal from the master material; a step (b) of feeding the first molten metal into the mold; a step (c) of providing the second molten metal by continuously feeding the additive element to the first molten metal in the mold to mix the additive element with the molten metal in the mold; and a step (d) of forming the cast material by continuously casting the second molten metal in the mold.

<Details of Additive-Element Feeding Step>

Next, details of the additive-element feeding step will be explained. In a wire rod such as the wire rod 80 used for the conductor wire or others, various additive elements are added to the master material in some cases in order to improve a function or characteristics at the time of the formation of the conductor wire. Such an additive element is added into a molten master-material metal. In consideration of workability of the addition of the additive element or a layout of apparatuses, the additive element is preferably added in the transfer launder 11 or the tundish 30 shown in FIG. 1. For example, in the tundish 30, a space that is enough for a removal work of the foreign substances is secured above the liquid surface of the molten metal since the step of skimming and removing the foreign substances included in the molten metal is performed in some cases. Therefore, by the addition of the additive element using this space, the work for the addition can be easily performed. Also, a layout space for the additive-element feeding apparatus is easily secured.

However, from the studies of the present inventors, it has been found that the method of adding the additive element in the transfer launder 11 or the tundish 30 has the following problems. Specifically, when the molten metal mixed with the additive element is poured into the mold 50 in the tundish 30 or others, the oxygen or others in the air between the mold 50 and the nozzle 31 connected to the tundish 30 storing the molten metal is easily included in the molten metal. Particularly when the additive element includes the element having the high activity to the oxygen, the oxygen and a part of the additive element adversely react with each other before the formation of the alloy. In this case, the oxidized additive element is often difficult to be melted in the molten metal. The cast material 81 does not include the additive element not melted in the molten metal. Therefore, in order to cause the additive element to be included at a predetermined ratio in the cast material 81, it is necessary to feed a large amount of the additive element in consideration of the ratio of the unmolten additive element. In other words, the reaction between the oxygen and the part of the additive element reduces the yield of the addition.

Also, if the ratio of the additive element reacting with the oxygen is high, the distribution of the additive element in the cast material 81 easily varies. Although described in detail later, when a ratio of the inclusion of the additive element is checked in each of a plurality of divided regions of a cross-sectional surface of the cast material 81, a high ratio of the inclusion of the additive element is locally caused in some cases. A region having an extremely high ratio of the inclusion of the additive element and a region having an extremely low ratio of the same cannot be used as products, and therefore, it is necessary to remove these regions. This case reduces an yield of an acquisition amount of the cast material 81 with respect to a preparation amount including the master material.

By the increase in the unmelted additive element in the molten metal, oxides of the additive element is deposited in a bottom of the tundish 30 or others, and therefore, this becomes a cause of reduction in a lifetime of the tundish 30 or others.

The above-described problem can be translated into an issue in a point of view of improvement of the manufacturing efficiency of the wire rod. In the point of view of improvement of the manufacturing efficiency of the wire rod, from the studies of the present inventors, it has been found that a technique of reducing the amount of the unmelted additive element in the molten metal or a technique of making the uniform distribution of the ratio of the inclusion of the additive element in the cross-sectional view of the cast material 81 is important.

Figure 3:
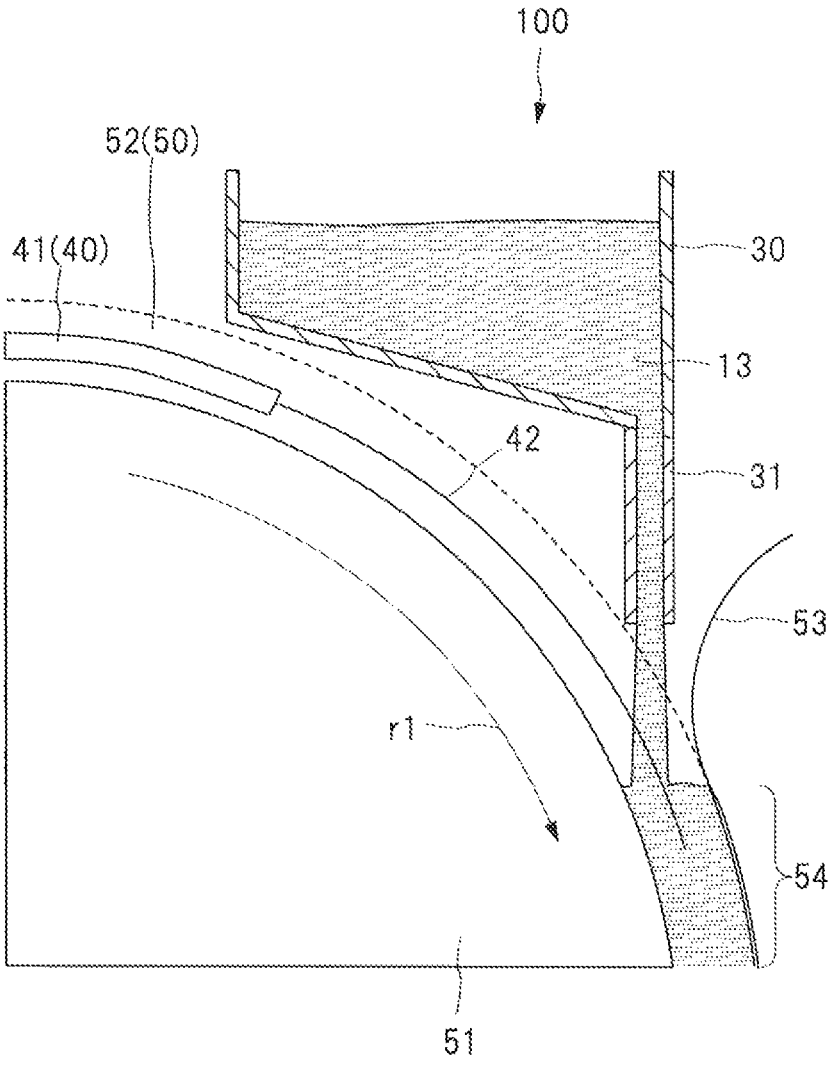
FIG. 3 is an explanatory diagram schematically showing a state of feeding a wire made of an additive element into a molten copper in vicinity of a feeding port of the mold.

FIG. 3 is an explanatory diagram schematically showing a state of vicinity of a feeding port of the mold shown in FIG. 2 in feeding of a wire made of the additive element into the molten metal (molten copper) 13. As shown in FIG. 3, an apparatus 100 of manufacturing the wire rod of the present embodiment is configured so that a wire 42 made of the linearly-shaped additive element can be fed from a feeding port of a mold 50 to a molten metal 13 in the mold 50. The wire 42 is continuously fed along a rotational direction of a casting wheel 51 from a nozzle 41 of an additive-element feeding unit 40. The nozzle 41 is arranged between the tundish 30 and the casting wheel 51.

In FIG. 3, a part of the mold 50 to which the molten metal 13 is fed from the nozzle 31 and in which the molten metal 13 is in a pre-hardening state (melting state) is defined as a pool unit 54. In the pool unit 54, a temperature of the molten metal 13 is high. And, to the pool unit 54, the new high-temperature molten metal 13 is sequentially fed. Therefore, in the pool unit 54, the molten metal 13 functioning as fluid circulates by convection.

In the present embodiment, the wire 42 is fed to the pool unit 54 of the mold 50, and is melted in the pool unit 54 by heat of the molten metal 13. In this case, the additive element before being inserted into the pool unit 54 is solid, and therefore, occurrence of the excess reaction with the oxygen can be suppressed even in a case of contact with the air including the oxygen.

Since the wire 42 is melted in the pool unit 54, the additive element becomes liquid. The molten metal 13 in the pool unit 54 has a smaller area of the part in contact with the air (area of the liquid surface) than that of the molten metal 13 in the tundish 30. Therefore, in the pool unit 54, a probability of the contact of the molten additional metal with the oxygen is lower than that in the tundish 30. As a result, the case of the method of the present embodiment can more suppress a frequency of the reaction of the additive element with the oxygen than that of the method of adding the additive element in the tundish 30. The yield of the addition of the additive element can be improved by the suppression of the reaction between the additive element and the oxygen, and therefore, the feeding amount of the additive element can be reduced. Also, by the suppression of the reaction between the additive element and the oxygen, an amount of generation of the oxides of the unmelted additive element remaining in the mold 50 can be reduced. Therefore, the reduction in the lifetime of the mold 50 due to the oxides of the additive element can be suppressed. If the additive element is not added in the tundish 30, the reduction in the lifetime of the tundish 30 due to the oxides of the additive element can be suppressed.

Since the molten metal 13 functioning as the fluid circulates by convection in the pool unit 54 as described above, the molten additive element is easily stirred. This result easily causes the uniform distribution of the additive element in the cast material 81 (see FIG. 1) resulted from the present embodiment. By the uniform distribution of the additive element in the cast material 81, the entire cast material 81 can be configured to be products. This result can improve the yield of the acquisition amount of the cast material 81 with respect to the preparation amount including the master member.

The present embodiment is particularly effective in usage of, as the additive element, the element having the higher activity to the oxygen than the metal (such as copper) functioning as the master material because of being able to suppress the frequency of the reaction between the additive element and the oxygen as described above.

As examples of the additive element, titanium (Ti), magnesium (Mg), zirconium (Zr), calcium (Ca), aluminium (Al), phosphorus (P), indium (In) or tin (Sn) can be exemplified. The number of the types of the additive element is not limited to one. For example, two or more types of the additive element of the above-described specific examples of the additive element may be added in some cases. An aspect in the case of adding the two or more types of the additive element will be described as a modification example later.

Figure 4:
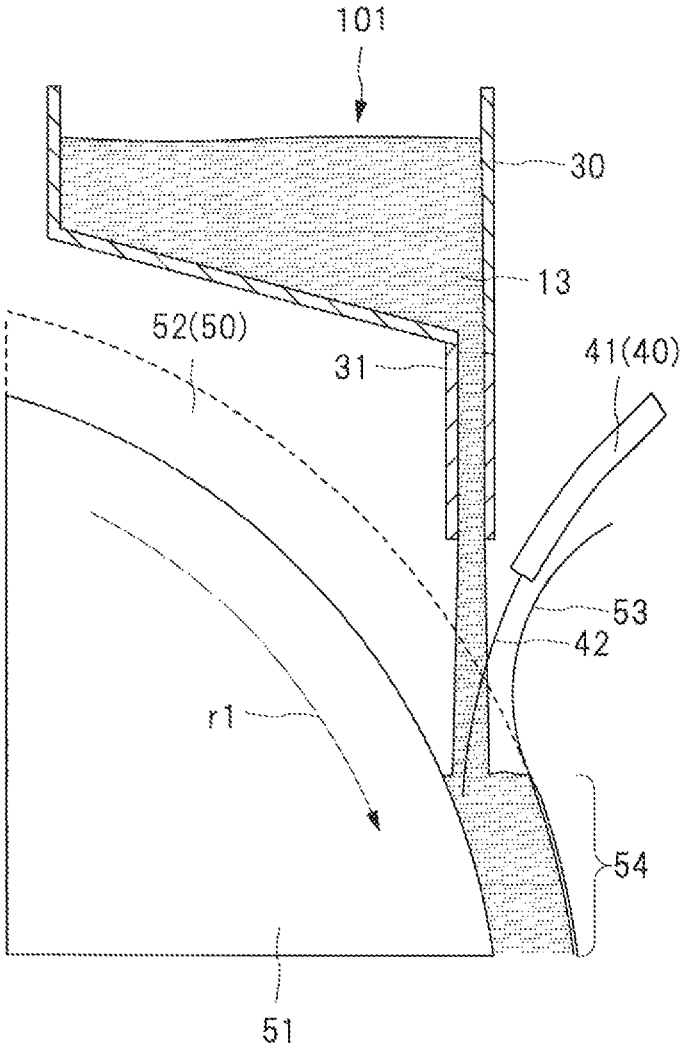
FIG. 4 is an explanatory diagram showing a modification example relative to FIG. 3.

Incidentally, as a modification example relative to the present embodiment, a method of feeding the wire 42 made of the additive element from a gap between the nozzle 31 and a casting belt 53 to the pool unit 54 of the mold 50 is exemplified as shown in FIG. 4. FIG. 4 is an explanatory diagram showing a modification example relative to FIG. 3. An apparatus 101 of manufacturing a wire rod shown in FIG. 4 is different from the apparatus 100 of manufacturing the wire rod shown in FIG. 3 in a direction of feeding the wire 42 made of the additive element. In the example shown in FIG. 4, a nozzle 41 for feeding the additive element is arranged between the nozzle 31 and the casting belt 53. This case causes a shorter distance from the nozzle 41 to the pool unit 54 than that of the example shown in FIG. 3, and therefore, a part of the wire 42 exposed to outside of the nozzle 41 can be shortened.

However, the example shown in FIG. 4 needs to secure a space for insertion of the nozzle 31 into the gap between the nozzle 31 and the casting belt 53, and therefore, the distance between the nozzle 31 and the pool unit 54 needs to be larger than that of the example shown in FIG. 3. In other words, when the nozzle 41 is arranged between the tundish 30 and the casting wheel 51 of the mold 50 as shown FIG. 3, the nozzle 31 and the pool unit 54 can be made close to each other. It is preferable to make the nozzle 31 and the pool unit 54 close to each other in order to reduce the contact area between the air and the molten metal 13 discharged from the nozzle 31 to reduce the oxygen in the air included into the molten metal 13. Therefore, the aspect shown in FIG. 3 is more preferable in order to suppress the inclusion of the oxygen in the air into the molten metal 13. The apparatus 101 of manufacturing the wire rod shown in FIG. 4 is the same as the apparatus 100 of manufacturing the wire rod shown in FIG. 3 except for the above-described difference, and therefore, the overlapping explanation will be omitted.

<Evaluation>

Figure 5:
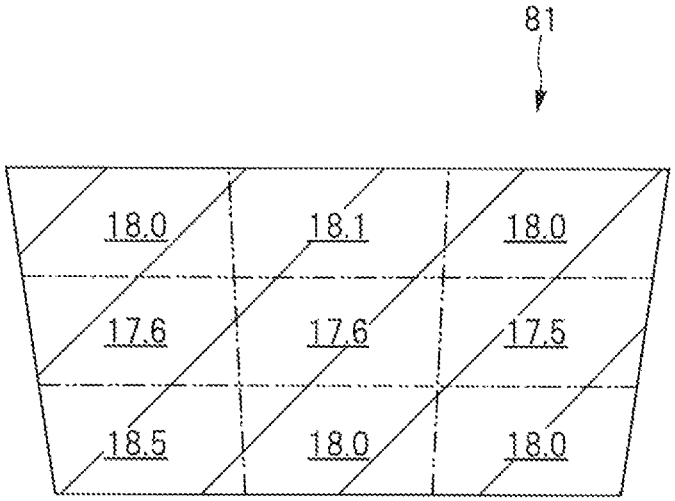
FIG. 5 is an explanatory diagram schematically showing measurement results of a concentration distribution of the additive element in each of nine divided regions of a cross section of a cast material that is manufactured by using an apparatus of manufacturing a wire rod shown in FIG. 3.
Figure 6:
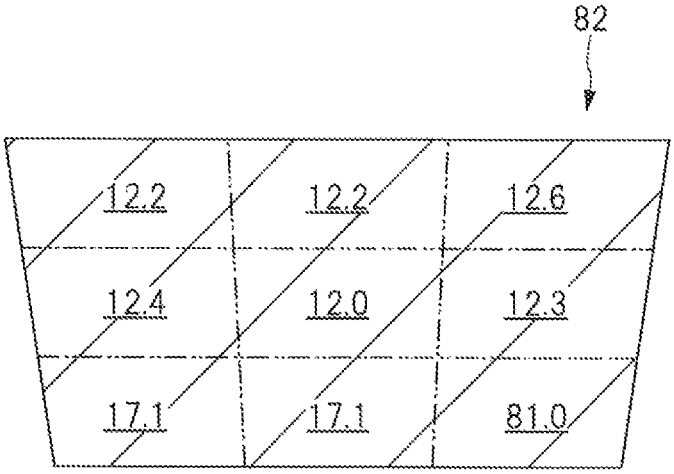
FIG. 6 is an explanatory diagram schematically showing measurement results of a concentration distribution of the additive element in each of nine divided regions of a cross section of a cast material that is manufactured by using an apparatus of manufacturing a wire rod according to a study example relative to FIG. 3.

In comparison between the cast material manufactured by the apparatus 100 of manufacturing the wire rod shown in FIG. 3 and the cast material manufactured by the apparatus of manufacturing the wire rod according to the study example relative to FIG. 3, evaluation results of the method of manufacturing the wire rod using the apparatus 100 of manufacturing the wire rod will be explained. FIG. 5 shows a working example, and is an explanatory diagram schematically showing a measuring result of a distribution of a concentration of the additive element in each of divided nine regions of the cross-sectional surface of the cast material manufactured by using the apparatus of manufacturing the wire rod shown in FIG. 3. FIG. 6 is an explanatory diagram schematically showing a measuring result of a distribution of a concentration of the additive element in each of divided nine regions of a cross-sectional surface of a cast material manufactured by using an apparatus of manufacturing a wire rod according to a comparison example relative to FIG. 3.

The cast material 81 shown in FIG. 5 and the cast material 82 shown in FIG. 6 are manufactured by manufacturing methods that are different from each other in a portion to which the additive element is fed. The cast material 81 shown in FIG. 5 is a cast material casted by the manufacturing method explained with reference to FIG. 3. On the other hand, the cast material 82 shown in FIG. 6 is a cast material casted by the apparatus of manufacturing the wire rod in which the wire 42 is not fed to the pool portion 54 shown in FIG. 3 but is fed to the tundish 30. Each of the cast material 81 shown in FIG. 5 and the cast material 82 shown in FIG. 6 has a cross section that is cut in a direction orthogonal to a longitudinal direction of the cast material shaped by the mold. Each of the cast material 81 and the cast material 82 has a trapezoidal cross section. As shown with a dashed double-dotted line in FIGS. 5 and 6, the cross section is divided into the nine regions. In FIGS. 5 and 6, the concentration of the additive element in each of the divided nine regions is shown in a ppm order. Each manufacturing condition for the cast material 81 shown in FIG. 5 and the cast material 82 shown in FIG. 6 is as follows. The master material is copper, and the additive element is titanium. The titanium has a higher activity to the oxygen than that of the copper. As the preparation amount of the additive element, the concentration of the additive element with respect to the entire alloy is set to 18 ppm in the working example shown in FIG. 5, or this is set to 42 ppm in the comparison example shown in FIG. 6.

As seen from the comparison between FIGS. 5 and 6, the method of manufacturing the wire rod according the present embodiment can reduce a deviation of the concentration of the additive element in each of the divided nine regions of the cast material 81. In the example shown in FIG. 5, the deviation is 0.31. In the cast material 82 shown in FIG. 6, the deviation of the concentration of the additive element in the nine regions is 52.7. In calculation of the deviation among remaining eight regions except for a region particularly having a high concentration on a right bottom side in the drawing sheet, the deviation is 5.2. Therefore, it has been found that the uniformity of the distribution of the additive element in the cast material 81 is significantly improved by the method of manufacturing the wire rod according the present embodiment.

An average of the concentrations of the nine regions shown in FIG. 5 is 17.9 ppm. The yield of the additive element included in the cast material 81 with respect to the preparation amount (18 ppm) of the additive element is 99.5%. In the cast material 82 shown in FIG. 6, the additive element is ununiformly included in the right bottom region of the drawing sheet, and therefore, an average of the same among the eight regions except for this region is 31.5 ppm. The yield of the additive element included in the cast material 82 with respect to the preparation amount (42 ppm) of the additive element is 74.9%. This result shows that the additive element can be efficiently included in the cast material 81 by the method of manufacturing the wire rod according the present embodiment.

In the examples shown in FIGS. 5 and 6, titanium is used as one example of the additive element. However, even a case of changing the additive element into, for example, magnesium (Mg), zirconium (Zr), calcium (Ca), aluminium (Al), phosphorus (P), indium (In) or tin (Sn) can provide the same result. And, even a case of changing the preparation amount in a range of 1% or lower of the concentration of the additive element in the cast material 81 can provide the same result.

<Example of Adding Plurality of Additive Elements>

Figure 7:
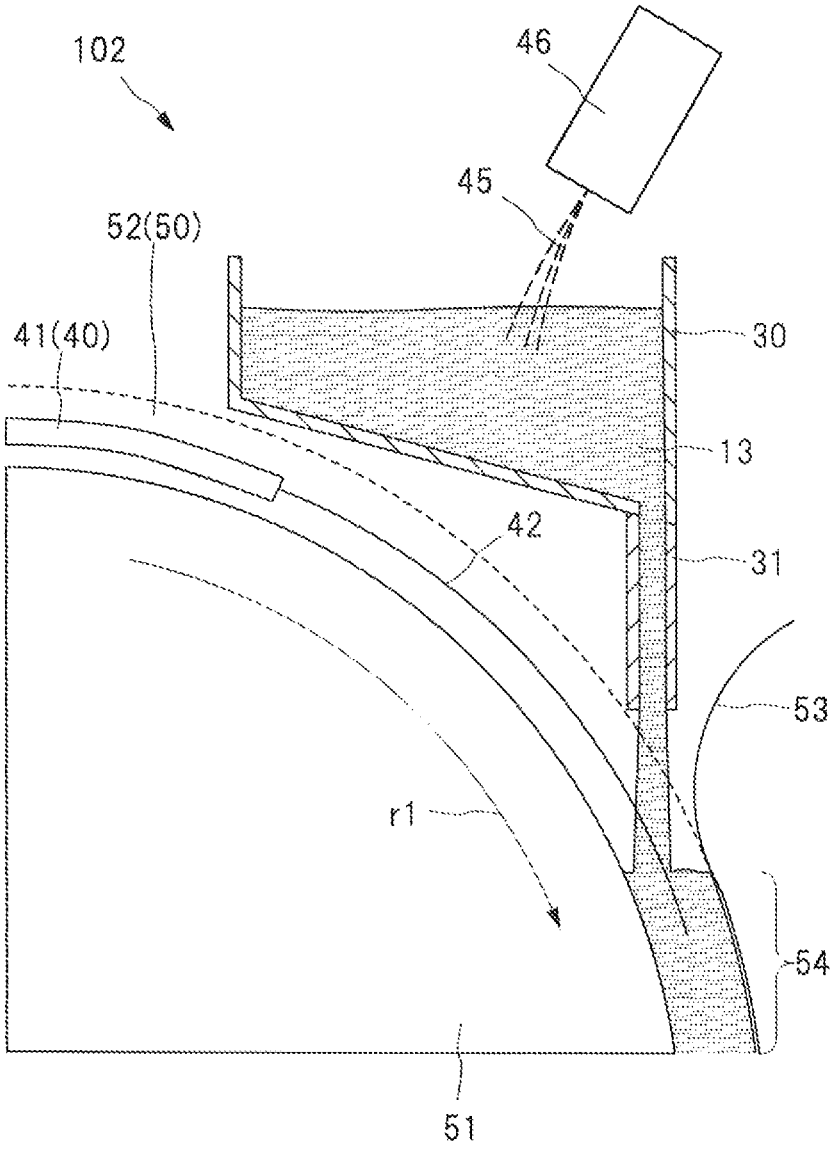
FIG. 7 is an explanatory diagram showing a modification example.

Next, as a modification example relative to the examples shown in FIGS. 3 and 4, an aspect of the addition of the plurality of types of the additive element will be explained. FIG. 7 is an explanatory diagram showing another modification example relative to FIG. 3. An apparatus 102 of manufacturing a wire rod shown in FIG. 7 includes an additive-element feeding unit 46 sequentially feeding an additive 45 made of a second additive element to the molten metal 13 in the tundish 30 in addition to the additive-element feeding unit 40 having the nozzle 41 sequentially feeding the wire 42 made of the first additive element.

As described above, in order to suppress the reaction between the additive element and the oxygen, the additive element is preferably fed into the mold 50. However, in the case of feeding the plurality of additive elements, a method of previously adding a part of the plurality of additive elements in the tundish 30 as shown in the modification example of FIG. 7 is considerable depending on the number of the additive elements because of the device layout in periphery of the pool unit 54.

The case of the addition of the additive element in the tundish 30 has a higher possibility of the reaction with the oxygen than that of the case of the addition of the additive element in the mold 50. Therefore, in the method of manufacturing the wire rod using the apparatus 102 of manufacturing the wire rod shown in FIG. 7, it is important to select the type of the additive element.

Specifically, in the additive-element feeding step in the present modification example, the wire 42 made of the first additive element is continuously fed to the molten metal in the mold 50. And, the molten metal 13 fed into the mold 50 in the molten-metal feeding step includes a first metal (such as copper) that is the master material and the second additive element having a lower activity to the oxygen than that of the first additive element. The additive 45 made of the second additive element is, for example, phosphorus. The first additive element making the wire 42 is, for example, titanium, zirconium or magnesium. In such a combination, the second additive element has the lower activity to the oxygen than that of the first additive element. Therefore, in the tundish 30, the frequency of the reaction between the additive element and the oxygen can be suppressed in comparison with the case of the addition of the first additive element.

Although not illustrated, a case of a plurality of wires 42 fed from the additive-element feeding unit 40 in the apparatus 100 of manufacturing the wire rod shown in FIG. 3 is exemplified as a modification example relative to FIG. 7. In this case, a case of the same additive element among the plurality of wires 42 and a case of a different additive element among the plurality of wires 42 are exemplified. For example, a case of the indium as the first additive element making one wire 42 while the tin as the second additive element making the other wire 42 is exemplified. In this modification example, a concentration of the addition of the first additive element and a concentration of the addition of the second additive element can be made different from each other.

In the embodiments, the method of manufacturing the wire rod and the apparatus of manufacturing the wire rod have been explained. The steps up to the formation of the cast material 81 shown in FIG. 1 can be extracted from the method of manufacturing the wire rod, and can be configured as a method of manufacturing the cast material and an apparatus of manufacturing the same.

The present invention is not limited to the foregoing embodiments and working examples, and various modifications can be made within the scope of the present invention.

For example, the method of sequentially feeding the linearly-shaped additive element into the molten metal has been explained as the method of feeding the additive element. However, as a modification example, a tablet additive element schematically shown as the additive 45 in FIG. 7 is continuously fed into the molten metal 13 of the pool unit 54 shown in FIG. 3, 4 or 7 in some cases.

The present invention is widely applicable to various conductor wires typically represented as an electric wire.

What is claimed is:

1. A method of manufacturing a wire rod by continuous cast rolling, comprising the steps of:

(a) providing a molten metal made of copper to a tundish;

(b) feeding the molten metal from the tundish into a mold via a nozzle;

(c) continuously feeding an additive element directly to the molten metal in the mold without passing through the tundish and the nozzle to mix the additive element with the molten metal in the mold, wherein the additive element is one, two or more types of the additive elements of titanium (Ti), magnesium (Mg), zirconium (Zr), calcium (Ca), aluminum (Al), phosphorus (P), indium (In) and tin (Sn); and (d) continuously casting the molten metal mixed with the additive element in the mold to form a cast material.

2. The method of manufacturing the wire rod according to claim 1, wherein the additive element has a higher activity to oxygen than the copper.

3. The method of manufacturing the wire rod according to claim 1, wherein the additive element is made of a linear substance, and is continuously fed to the molten metal into a groove of a casting wheel of the mold from an additive-element feeding nozzle arranged between the mold and a tundish storing the molten metal not yet fed to the mold.

4. The method of manufacturing the wire rod according to claim 1, wherein, in the step (c), a first additive element is continuously fed to the molten metal in the mold, and the molten metal fed to the mold in the step (b) includes the copper and a second additive element having lower activity to oxygen than the first additive element.

5. An apparatus of manufacturing a wire rod by continuous cast rolling, comprising:

a tundish storing a molten metal;

a casting wheel for use in continuously casting the molten metal fed from the tundish; and an additive-element feeding unit continuously feeding an additive element directly into a feeding port of a groove of the casting wheel without passing through the tundish.

6. The apparatus of manufacturing the wire rod according to claim 5, wherein the additive-element feeding unit includes an additive-element feeding nozzle made of a linear substance and continuously feeding the additive element to the feeding port of the casting wheel, and the additive-element feeding nozzle is arranged between the casting wheel and the tundish.

7. A method of manufacturing a wire rod by continuous cast rolling, comprising the steps of:

(a) providing a molten metal made of a master material to a tundish;

(b) feeding the molten metal from the tundish into a mold via a nozzle;

(c) continuously feeding an additive element directly to the molten metal in the mold without passing through the tundish and the nozzle to mix the additive element with the molten metal in the mold; and (d) continuously casting the molten metal mixed with the additive element in the mold to form a cast material, wherein the additive element is made of a linear substance, and is continuously fed to the molten metal into a groove of a casting wheel of the mold from an additive-element feeding nozzle arranged between the mold and a tundish storing the molten metal not yet fed to the mold.

* * * * *